US006773140B2

(12) United States Patent
Lee

(10) Patent No.: US 6,773,140 B2
(45) Date of Patent: Aug. 10, 2004

(54) STRUCTURE OF LIGHTING UNIT OF A TENT

(76) Inventor: Chorng-Cheng Lee, No. 272, Lane 365, Wu Feng South Road, Chia Yi (TW)

( * ) Notice: Subject to any disclaimer, the term of this patent is extended or adjusted under 35 U.S.C. 154(b) by 0 days.

(21) Appl. No.: 10/241,687

(22) Filed: Sep. 12, 2002

(65) Prior Publication Data

US 2004/0052075 A1 Mar. 18, 2004

(51) Int. Cl.[7] ..... F21V 21/00

(52) U.S. Cl. ..... 362/249; 362/252; 362/225; 362/227; 362/238; 362/239; 362/145; 362/152; 362/102; 135/91; 135/121; 135/161; 135/908

(58) Field of Search ..... 362/249, 252, 362/225, 227, 238, 239, 145, 152, 102; 135/91, 121–161, 908

(56) References Cited

U.S. PATENT DOCUMENTS 4,865,066 A * 9/1989 Brooks ..... 135/121
6,305,822 B1 * 10/2001 Lin ..... 362/249

* cited by examiner

*Primary Examiner*—Stephen Husar
*Assistant Examiner*—B. Zeade
(74) *Attorney, Agent, or Firm*—Rosenberg, Klein & Lee

(57) ABSTRACT

A lighting unit of a tent includes lamps, wires provided for connecting the lamps to power, and holding trenches formed along lower sides of upper rod portions of a supporting frame of the tent. Each of the holding trenches is made to have a slot narrower than a middle room thereof, and the lamps have a diameter bigger than width of the slot so as not to fall down when held in the trenches. Thus, the lamps are hidden in the holding trenches to not badly affect appearance of the tent. And, light emitting diodes can be used as the lamps to help make the tent attractive.

4 Claims, 10 Drawing Sheets

STRUCTURE OF LIGHTING UNIT OF A TENT

BACKGROUND OF THE INVENTION

1. Field of the Invention

The present invention relates to a lighting unit of a tent, more particularly a lighting unit, which can be arranged in such position that appearance of the tent will not be badly effected by presence thereof, and which can help increase good atmosphere at night for people using the tent with light thereof.

2. Brief Description of the Prior Art

Tents are indispensable equipments for people who go camping or travel in a cheap way. Tents shelter the users from wind, insects and so on at night so that the users can sleep well, and can shelter the users from sunlight and rain, too.

However, most conventional tents not equipped with lighting devices. Consequently, the users do not have enough illumination while they are in the tents. Other lights that are located outside the tents will not effectively increase illumination in the tents because the covering cloth will block the light. Therefore, many lights have to be disposed around the tents or lights have to be moved closer to the tents for the users to have enough illumination, costing a lot of labor and inconvenience.

To overcome this disadvantage, referring to FIGS. 10 and 11, a conventional tent has an upper support 21, lamps (not shown), transverse rods 22, fixing blocks 214, covering cloth (not shown), and upright rods (not numbered). The upper support 21 includes a chief connecting member 211, and four upper support rods 212. Each of the upper support rods 212 is pivoted to the chief connecting member 211 at the upper end by means of a steel wire 3. The upper support rods 212 have insertion portions 215 at the lower ends. Each of the fixing blocks 214 has several connecting tube portions 216 extending to certain directions. The lamps have protrusions sticking from lateral sides, and the upper support rods 212 have holding trenches, which are formed with corresponding cavities for the lateral protrusions of the rods 212.

To assemble the tent for use, lower ends of the insertion portions 215 are inserted into an uppermost tube portion 216 of corresponding fixing blocks 214. And, the transverse rods 22, and the upright rods are inserted corresponding ones of the fixing blocks 214. The covering cloth is secured to the supporting rods. The lamps with the wires are contained in the trenches of the upper support rods 212 with the lateral protrusions being fitted into corresponding cavities of the rods 212. Thus, the lamps can provide illumination from inside of the tent.

In addition, referring to FIG. 12, which is disclosed in the U.S. Pat. No. 6,302,560. The U.S. patent also has a rod having a holding trench and the lamps can be put into the holding trench.

However, the tents are found to have drawbacks as followings:

1. The holding trenches of the upper rods 212 are made to have specialized shape, therefore only the lamps, which are particularly made to fit the trenches, can be used in this tent. Consequently, the trenches do not allow the users to substitute other kinds of lamps for the present ones, causing a lot of inconvenience.
2. The manufacturers have to make specialized moulds for such lamps therefore the cost of the tent is increased, reducing competitiveness of the product in the market.

SUMMARY OF THE INVENTION

It is a main object of the present invention to provide a lighting unit for a tent, which can be easily fitted in position, and which can be arranged in such a manner that appearance of the tent will not be badly affected.

It is another object of the present invention to provide a lighting unit, which can be securely hung on the upper support rods of the tent without possibility of falling down.

It is yet another object of the present invention to provide a lighting unit for a tent, which can help be fitted in position with the wires being hidden to not badly affect appearance of the tent.

The present lighting unit of a tent includes lamps, wires provided for connecting the lamps to power, and holding trenches formed along upper rod portions of a supporting frame of the tent.

The holding trenches are formed along upper sides of the rod portions for holding the wires therein. Each of the rod portions has through holes extending from the lower side and equidistantly spaced along same to communicate with the holding trench thereof. The wires is positioned along inner spaces of the holding trenches of corresponding rod portions, and passed through the through holes to be connected to the lamps so that the lamps are hung under the second sides of the rod portions when the tent is spread for use.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 7:
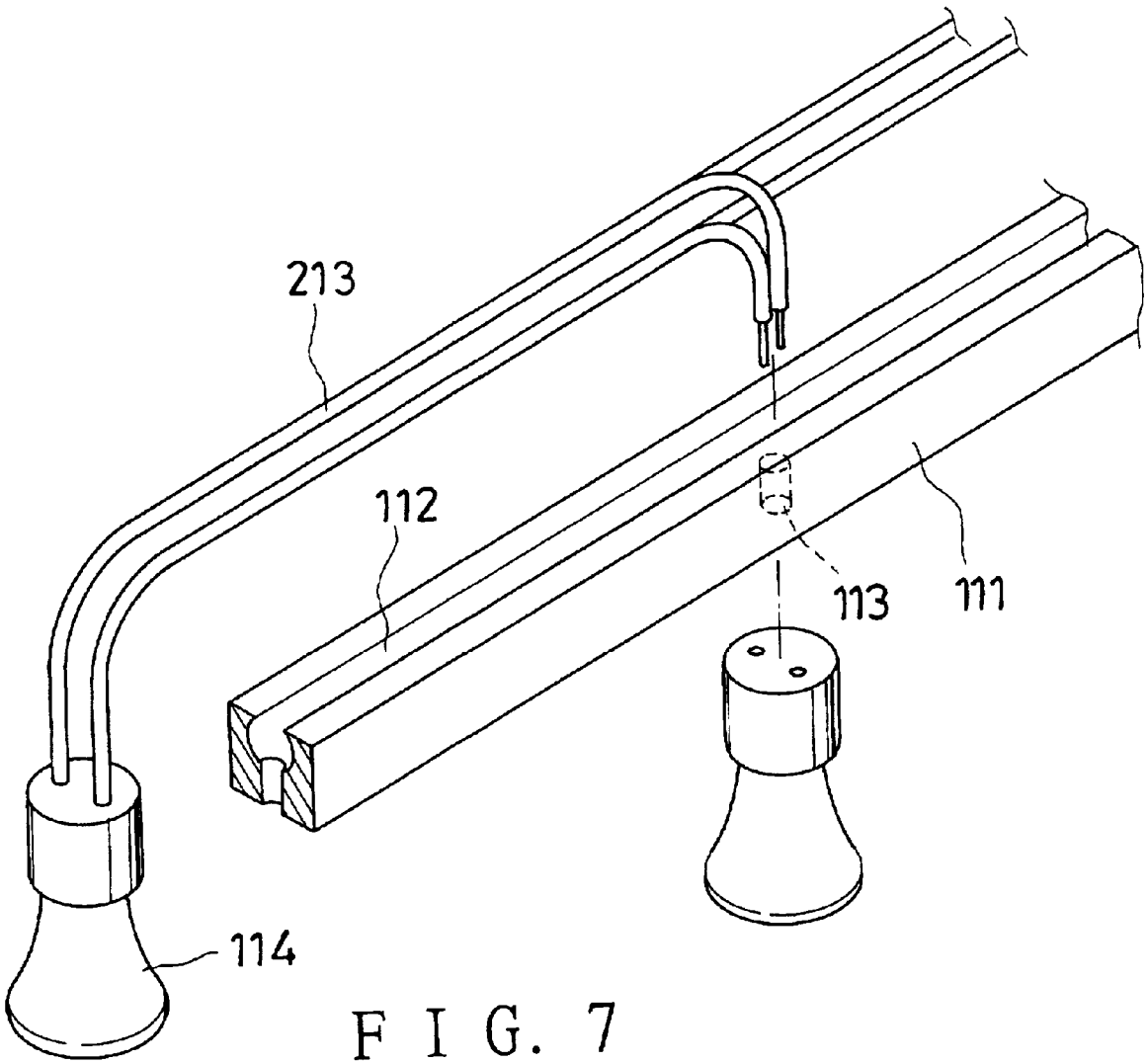
FIG. 7 is a fragmentary exploded perspective view of the lighting unit of yet another embodiment.
Figure 8:
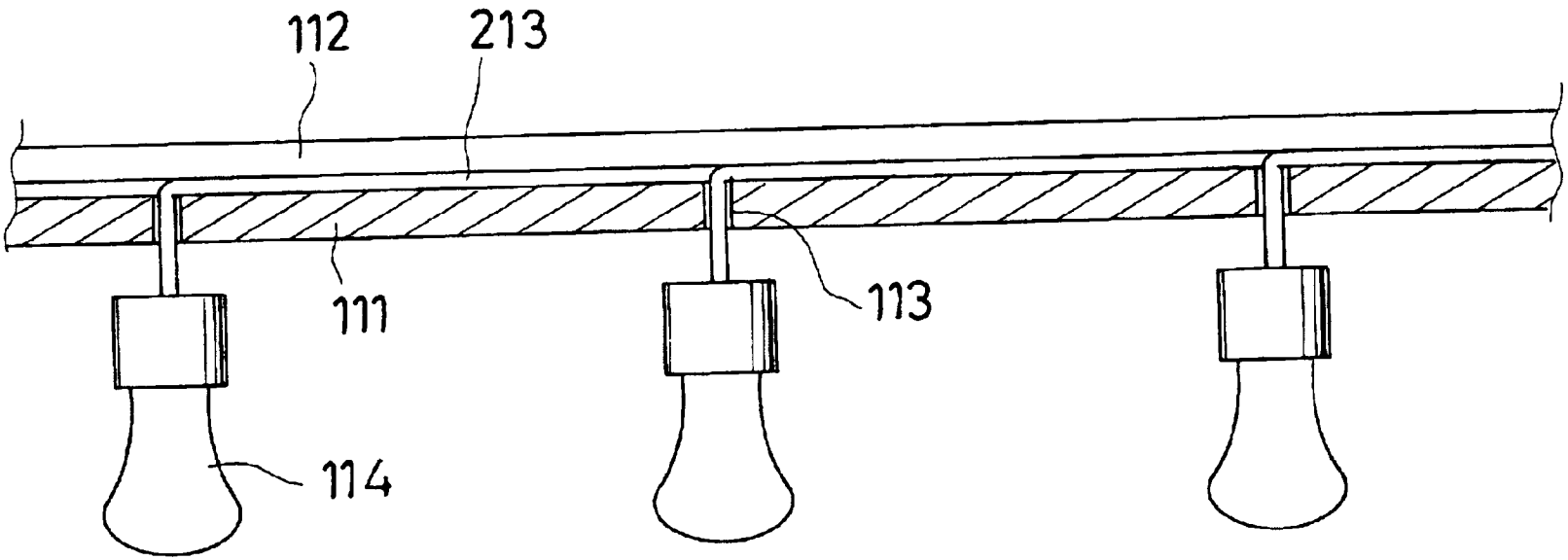
FIG. 8 is a partial cross-sectional view of the lighting unit of the present invention as shown in FIG. 7.
Figure 9:
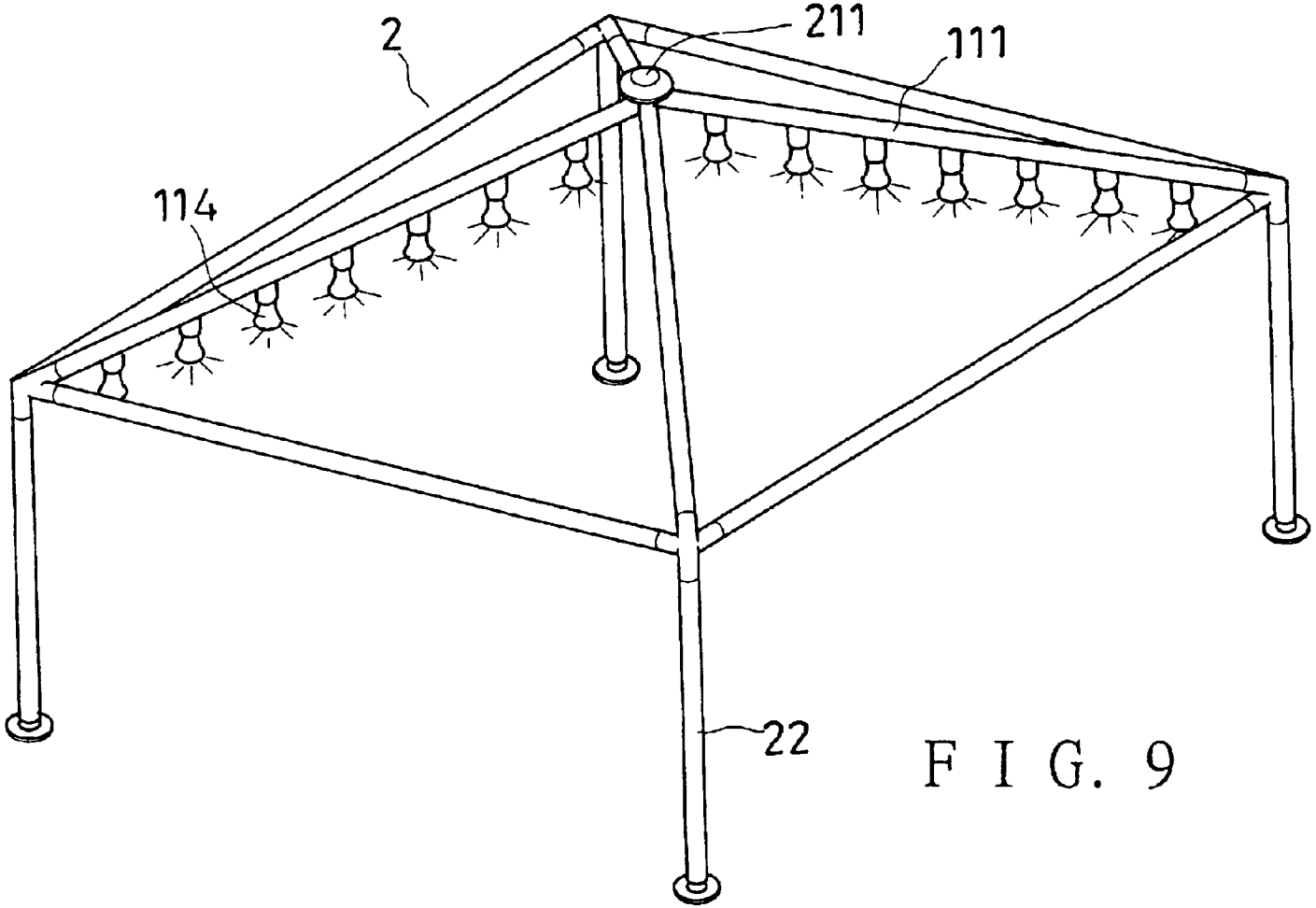
FIG. 9 is a view of a tent having the lighting unit according to the present invention.
Figure 10:
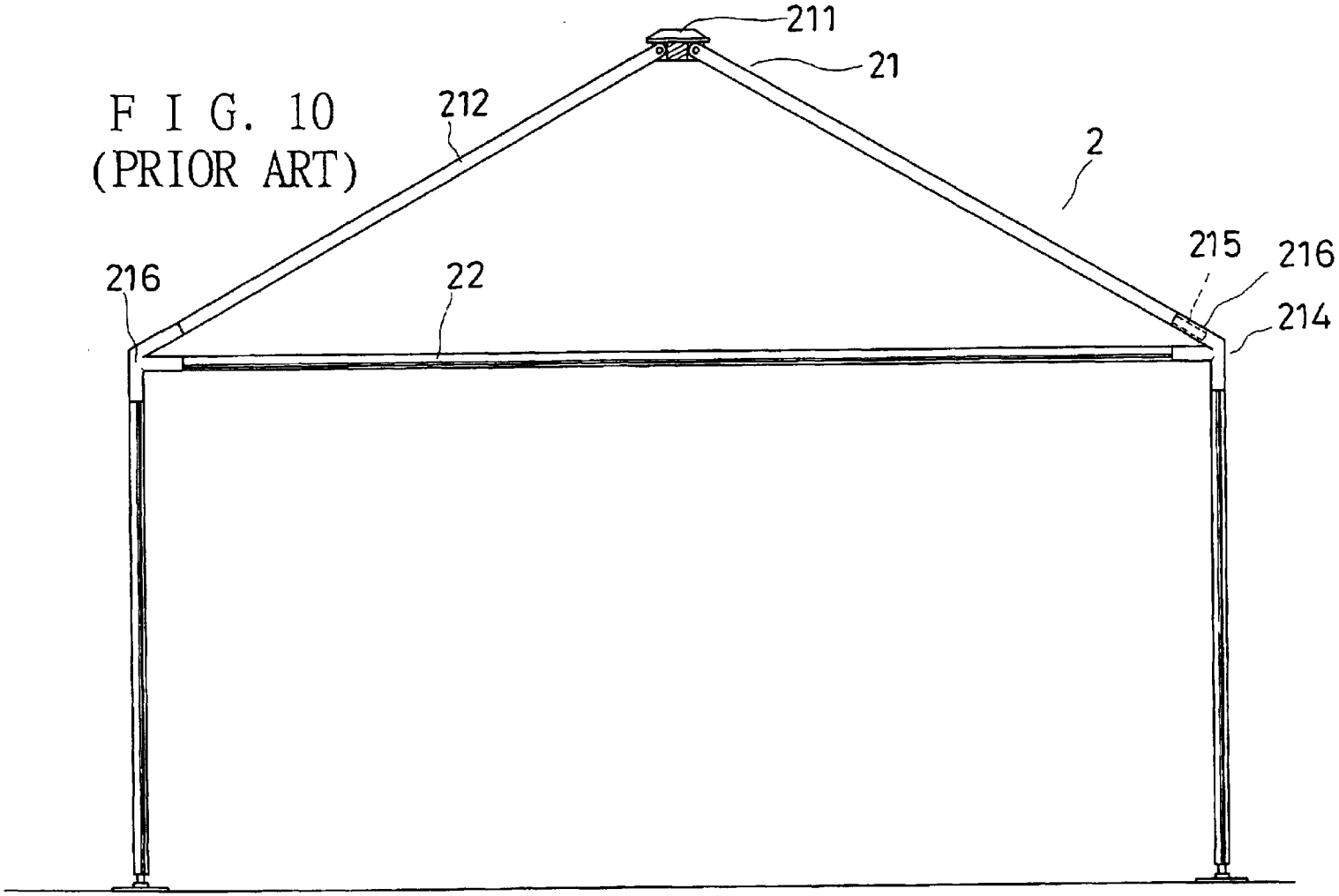
FIG. 10 (PRIOR ART)
FIG. 10 is a side view of the conventional tent having lighting devices as described in the Background.
Figure 11:
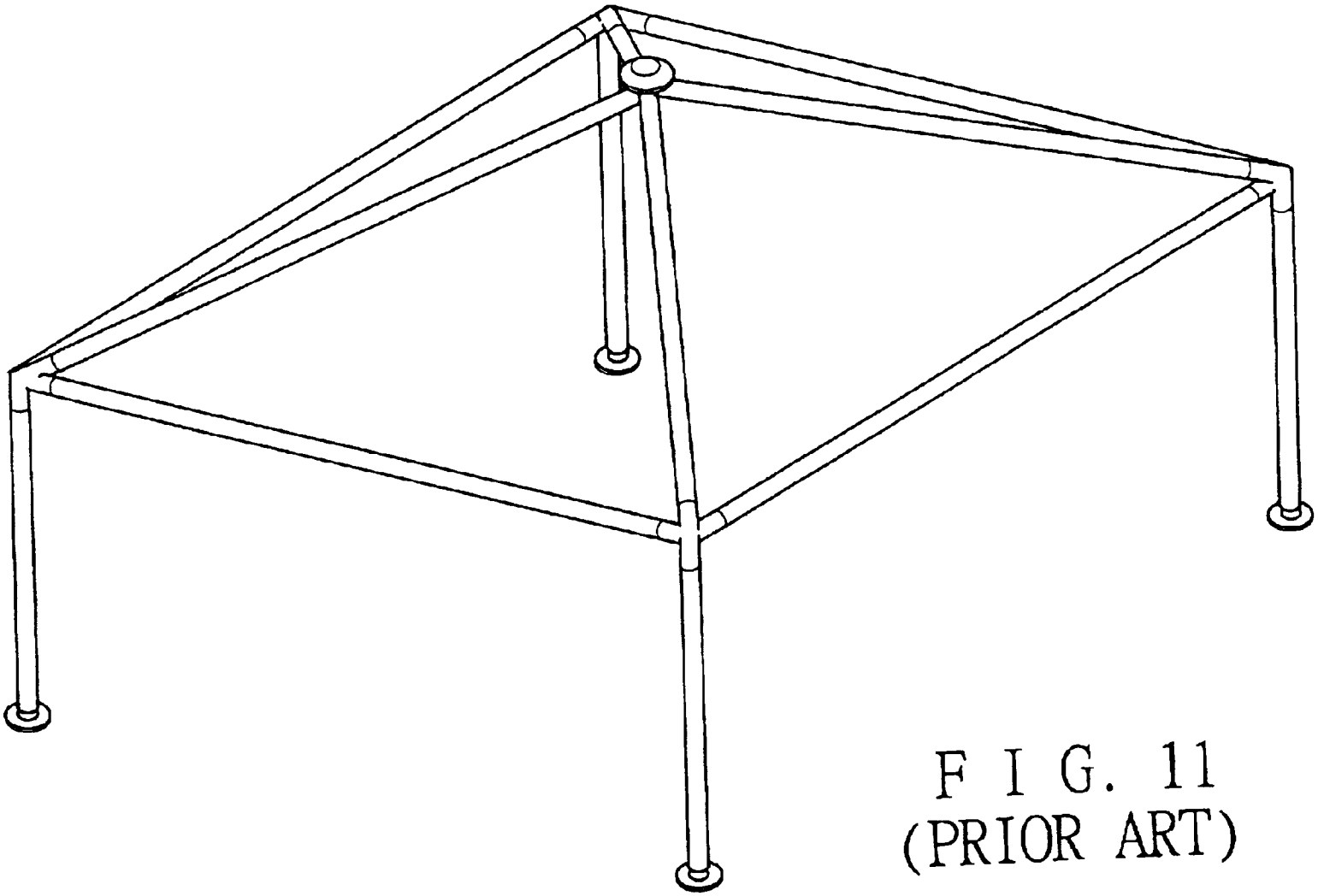
FIG. 11 (PRIOR ART)
FIG. 11 is a perspective view of the conventional tent having lighting devices.
Figure 12:
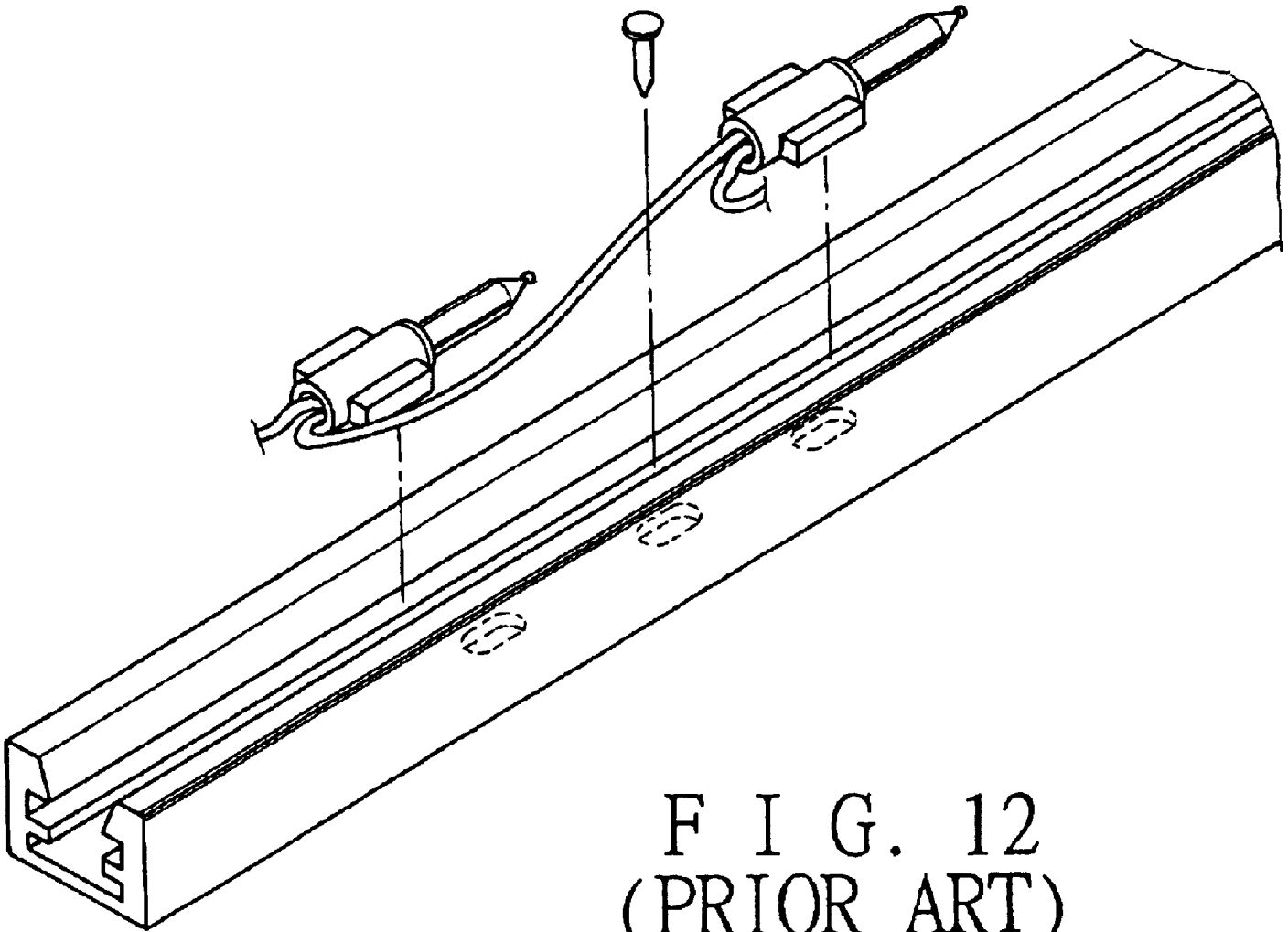
FIG. 12 (PRIOR ART)
FIG. 12 is a drawing of the U.S. Pat. No. 6,302,560.

Referring to FIGS. 7, 8 and 9, a tent is equipped with lighting units according to the present invention. The tent has lamps 114, covering cloth (not shown), and a support frame consisting of a chief connecting member 211, four upper support rods 111, transverse rods, corner connectors (not numbered), and upright rods 22. Each of the upper support rods 111 is pivoted to the chief connecting member 211 at the upper end by means of a steel wire 3. Each of the corner connectors has several connecting tube portions extending to certain directions. Each of the upper support rods 111 has a holding trench 112 formed along it on the upper side thereof. Each of the upper support rods 111 has through holes 113, which extend from the lower side to communicate with the holding trench 112, and which are preferably equidistantly spaced.

Lower ends of the upper support rods 111, the transverse rods, and the upright rods are inserted into corresponding tube portions of the corner connectors.

In combination, the wires 213 are positioned along inner rooms of the holding trenches 112, and passed through the through holes 113. The lamps 114 are connected to those portions of the wires 213 that are passed through the holes 113 to be hung on the rods 111. Thus, the lamps can provide illumination from inside of the tent. Furthermore, conventional Christmas lamps, and light emitting diodes can be used as the lamps.

Figure 1:
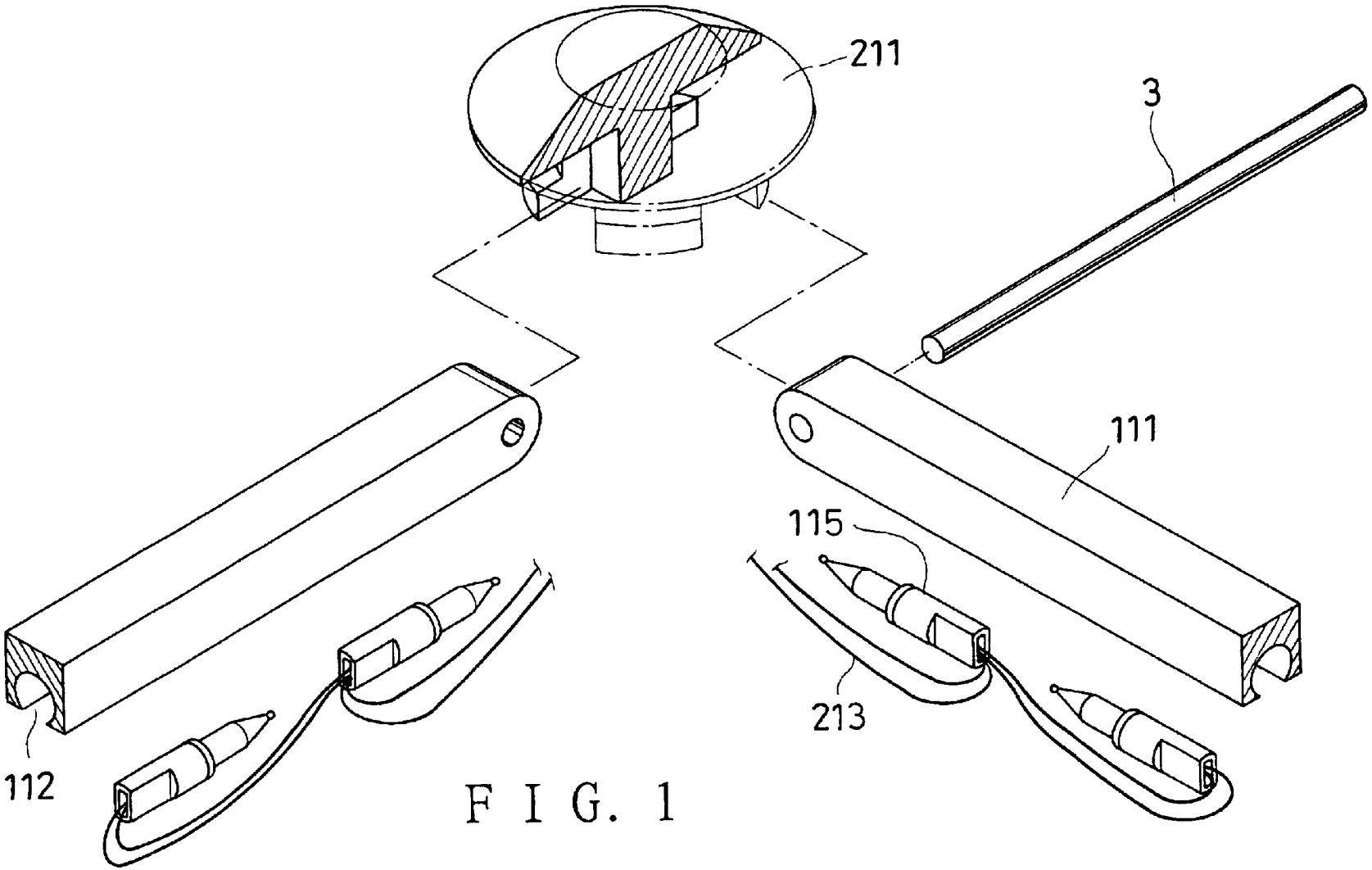
FIG. 1 is a fragmentary exploded perspective view of the lighting unit of a tent according to the present invention.
Figures 2, 3:
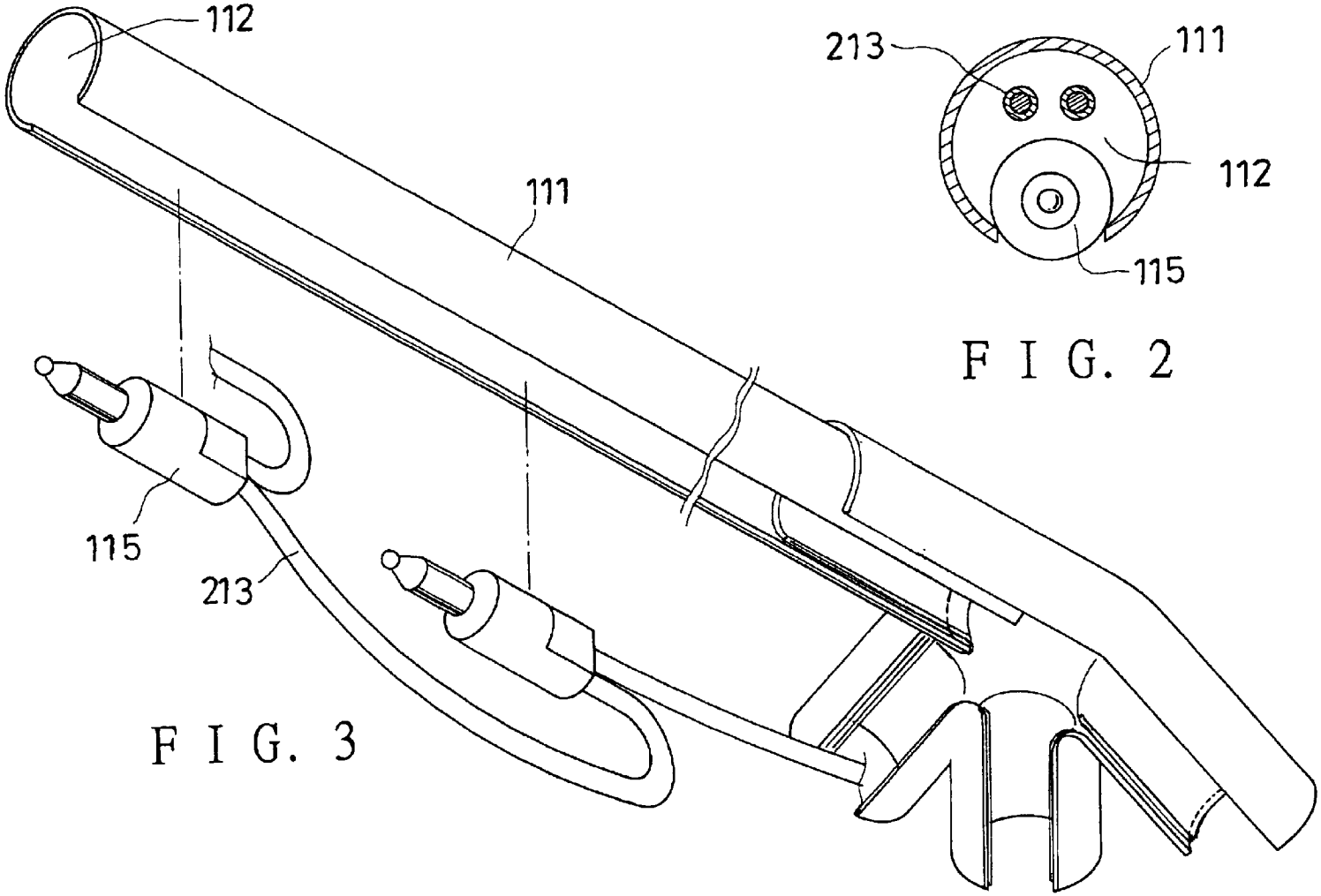
FIG. 2 is a partial cross-sectional view of the lighting unit of a tent according to the present invention.
FIG. 3 is another fragmentary exploded perspective view of the lighting unit of the present invention.

Referring to FIGS. 1, 2 and 3, in a second embodiment of the present invention, the upper support rods 111 have holding trenches 112 formed along the lower sides thereof. Each of the holding trenches 112 has an opening slot narrower than a middle room thereof. In combination, lamps 115 and wires 213 connected to the lamps 115 are positioned along the holding trenches 112 of corresponding rod portions 111. The lamps 115 are made to have a diameter bigger than the width of the opening slots of the holding trenches 112 so that the lamps 115 and the wires 213 cannot fall out of the holding trenches 112.

Figure 4:
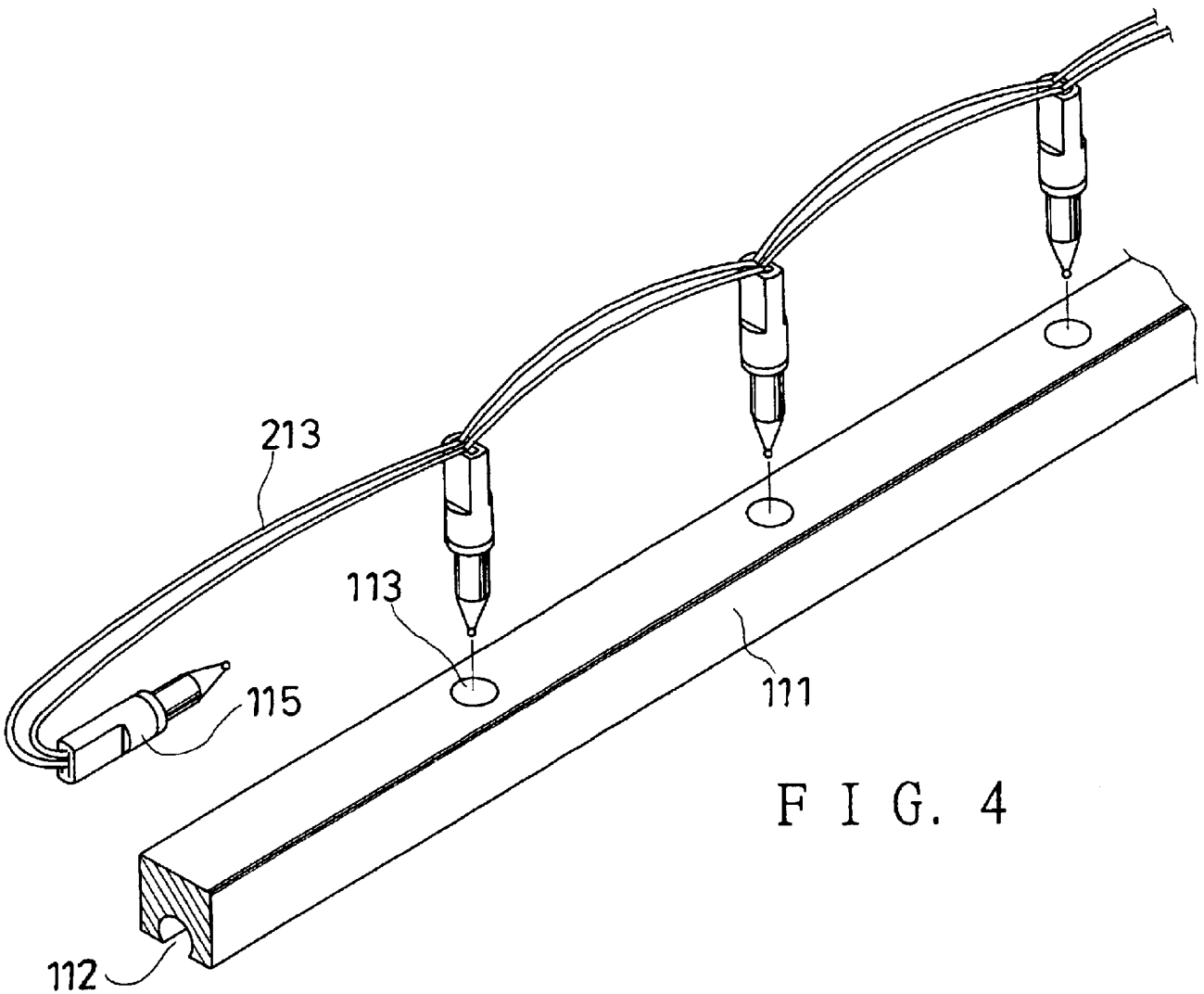
FIG. 4 is a fragmentary exploded perspective view of the lighting unit of another embodiment.
Figure 6:
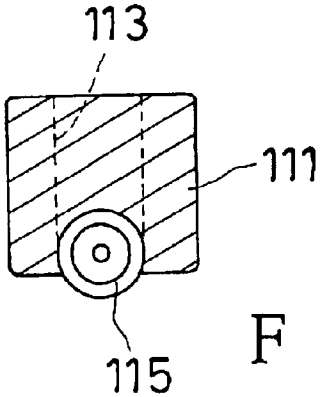
FIG. 6 is another partial cross-sectional view of the lighting unit as shown in FIG. 4.
Figure 5:
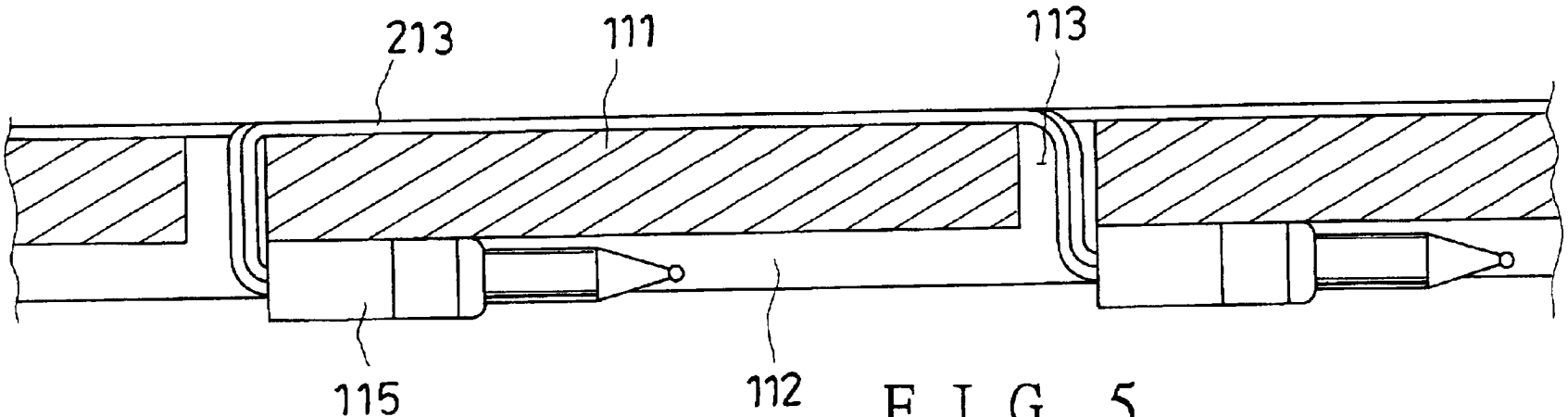
FIG. 5 is a partial cross-sectional view of the lighting unit of the present invention as shown in FIG. 4.

Referring to FIGS. 4, 5 and 6, the upper support rods 111 of the second embodiment further have through holes 113, which extend from the upper sides thereof to communicate with the holding trenches 112, and which are preferably equidistantly spaced. In combination, wires 213 are positioned along the upper sides of the upper support rods 111, and passed through the through holes 113, while lamps 115 are deposited in the holding trenches 112, and connected to those portions of the wires 213 that are passed through the holes 113. Thus, the lamps 115 are spaced out with distance being not possible to be changed due to the through holes 113. The lamps 115 cannot fall out of the holding trenches 112 because the opening slots of the trenches 112 are narrower than the diameter of the lamps 115.

From the above description, it can be easily understood that the lighting unit for a tent according to the present invention has the following desirable features:

1. The lamps of the second embodiment can be securely supported in the trenches of the upper support rods, not possible to fall down.
2. The lamps of the lighting unit of the third embodiment are further fixed in position with the wires because the wires connected thereto are passed through the through holes of the upper support rods. The wires are further hidden in the holding trenches to not show to badly affect appearance of the tent.
3. A wide variety of conventional lamps, e.g. Christmas lamps and light emitting diodes, can be used in the present lighting unit, therefore the manufacturer do not have to make additional moulds, saving a lot of cost, and making the product more competitive.

What is claimed is:

1. A lighting unit for a tent, comprising:

a plurality of lamps electrically connected to wires;

a tent supporting frame including a plurality of rod portions having holding trenches formed longitudinally along first sides thereof to hold the lamps therein, each holding trench defining an inner space converging to a narrowed opening; each of the rod portions having a second side opposite to the first side thereof;

the lamps being positioned and retained in the holding trenches of corresponding rod portions to be spaced longitudinally therealong, whereby lighting for the tent is substantially integrated into the tent supporting frame.

2. The lighting unit for a tent as claimed in claim 1, wherein each of the rod portions of the supporting frame has a plurality of through holes equidistantly spaced therealong to communicate with the holding trench thereof; the wires being positioned on the second side of a corresponding rod portion, and passed through the through holes of a corresponding rod portion so that the lamps and the wires are disposed along opposite side of corresponding rod portions.

3. The lighting unit for a tent as claimed in claim 2, wherein the rod portions, which the holding trenches are formed along, are positioned in such a manner that the first sides thereof face down when the tent supporting frame is configured for use.

4. A lighting unit for a tent, comprising:

a plurality of lamps;

wires provided for connecting the lamps to power;

a tent supporting frame including a plurality of rod portions having holding trenches formed longitudinally along upper sides thereof for holding the wires therein, each holding trench defining an inner space converging to a narrowed opening; each of the rod portions having through holes extending from a lower side thereof in equidistantly spaced manner to communicate with the holding trench thereof; the upper sides of the rod portions facing up when the tent supporting frame is configured for use;

the wires being positioned along and retained within the inner spaces of the holding trenches of corresponding rod portions; the wires being passed through the through holes of corresponding rod portions, and connected to the lamps so that the lamps are hung under the lower sides of the rod portions spaced longitudinally therealong when the tent supporting frame is configured for use.

* * * * *